United States Patent [19]

Riehlmann

[11] 3,997,026

[45] Dec. 14, 1976

[54] COLLAPSIBLE LADDER ASSEMBLY SUITABLE FOR USE AS FIRE ESCAPE

[76] Inventor: Joseph F. Riehlmann, 5862 Fleur de Lis Drive, New Orleans, La. 70100

[22] Filed: Apr. 11, 1975

[21] Appl. No.: 567,133

Related U.S. Application Data

[63] Continuation-in-part of Ser. No. 427,012, Dec. 13, 1973, Pat. No. 3,946,833.

[52] U.S. Cl. ..... 182/96; 182/18; 182/70; 182/195

[51] Int. Cl.[2] ..... E06C 9/06

[58] Field of Search ..... 182/70, 95, 96, 195, 182/94, 18

[56] References Cited

UNITED STATES PATENTS

| | | | |
|---|---|---|---|
| 268,078 | 11/1882 | Bushnell | 182/94 |
| 887,550 | 5/1908 | Broekhoven | 182/96 |
| 1,015,173 | 1/1912 | Grunbaum | 182/95 |
| 3,061,042 | 10/1962 | Giles | 182/195 |
| 3,136,386 | 6/1964 | Horvath | 182/96 |
| 3,392,380 | 7/1968 | Fordyce | 182/18 |
| 3,601,220 | 8/1971 | Saucier | 182/96 |

FOREIGN PATENTS OR APPLICATIONS

| | | | |
|---|---|---|---|
| 1,175,094 | 11/1958 | France | 182/195 |

*Primary Examiner*—Reinaldo P. Machado
*Attorney, Agent, or Firm*—Plumley and Tyner

[57] ABSTRACT

A collapsible ladder assembly suitable for installation on high-rise buildings and capable of modification to be architecturally unobstrusive and compatible with a variety of architectural designs is described. The ladder assembly comprises a frame member, two or more telescoping stile pair sections and a plurality of rung members. In the normal storage position the ladder is disposed entirely within the frame member with the telescoping stile members in the retracted position. The entire unit is adapted to fit within a window opening. In a emergency the ladder can be released to the extended position for use from inside a window whereby it falls on hinged arms down and away from the building at a distance sufficient to permit passage of a person between the building and the ladder. Release of one ladder actuates a release mechanism on the similarly mounted ladder on the floor below and so on, allowing an escape passage to a safe level or, if necessary, to the ground.

8 Claims, 5 Drawing Figures

COLLAPSIBLE LADDER ASSEMBLY SUITABLE FOR USE AS FIRE ESCAPE

RELATED APPLICATIONS

This application is a continuation-in-part of my copending application Ser. No. 427,012, filed Dec. 13, 1973 now Pat. No. 3,946,833.

BACKGROUND OF THE INVENTION

This invention relates to collapsible ladders particularly suitable for use in series as an emergency escape mechanism for high-rise buildings.

Modern high-rise buildings are typically designed with no provision for emergency escape, such as during a fire, except for the elevators and internal stairways. Elevators are likely to be inoperative in a serious fire and are, in any event, not recommended as an escape route. Similarly, internal stairways often become blocked during a fire. As a consequence, a serious tragedy has occurred where internal escape routes are unavailable.

Accordingly, there is a need for alternative external escape means. Preferably, such escape means would be of a design versatile enough for installation on a large percentage of existing and future high-rise constructions which vary considerably in their designs. It is also desirable that such escape means not detract from the esthetic design of the building but that it be capable of modification to blend with any of a variety of architectural styles.

It is, therefore, an object of this invention to provide a collapsible ladder suitable for installation on high-rise structures for emergency escape.

It is a further object of this invention to provide a fire escape for high-rise buildings which is both highly functional and esthetically pleasing in design.

Another object of this invention is the provision of a collapsible ladder mounted in a frame which could be supplied as a single unit for easy incorporation into a high-rise building or other structure for example in a window opening.

Still another object of this invention is the provision of a fire-escape ladder capable of modification to blend with a variety of high-rise designs.

SUMMARY OF THE INVENTION

This invention relates to a ladder assembly adapted for installation in the window opening of a building comprising a frame member and a collapsible ladder comprising a plurality of telescoping stile pairs in which the ladder can be accommodated within the frame member in the storage position. The ladder is attached to the frame member by at least two pair of pivoting arms which permit movement of the ladder downwardly and outwardly from the frame member to a vertical position away from the frame member at a distance sufficient to allow passage of a person between the frame member and the ladder. The extended position of the ladder is determined by a tension member such as a cable connecting between the frame member and the ladder which limits the movement of the ladder on the pivoting arms to the desired position. At the same time as the ladder moves downwardly and outwardly the lower telescoping stile pairs slide out from within the upper telescoping stile pair to their extended position by gravity.

The ladder is held in the storage position by a trip lever attached to the ladder and which hooks over a bar on the inside of the frame. The trip lever extends outside the frame member so that a similar ladder falling from above can exert a downward force sufficient to disengage the trip lever from its hooked position. The trip lever can also be disengaged by an upward force exerted from inside the frame. Within the frame the telescoping sections are held in the collapsed position by a slide member angled to the outside of the frame which urges the rung on the lower stile to the collapsed position. Upon release of the trip lever the falling of the ladder downwardly and outwardly is assured by the sliding of the lower rung of the lower stile on the angled slide member until the lower rung clears the frame whereupon it is free to fall to its extended position.

Each floor of a high-rise building or other structure is provided with one of the afore-described ladder assemblies, each ladder assembly having a release mechanism actuated by the release of the ladder immediately above it. Thus, the release of the ladder section on an upper story causes the release of theladder immediately below it in turn releasing the next ladder below, one after the other, until all ladders are released in a "domino" effect allowing passage to the ground level. In order to accomplish the release of the lower ladder it is essential that the upper ladder have an extended length greater than its length in the collapsed position. Specifically, the extended length must be sufficient to reach the trip lever on the next lower ladder. In general it is considered that the extended length of the ladder must be at least 1.3 times the collapsed length in order to accomplish the desired release of the next lower ladder.

The ladder assembly can be installed in existing buildings as a unit by making the necessary size adjustments. The ladder can also be supplied as a structural unit attached within a window frame or use in new construction.

In itself, the ladder assembly of this invention having the cover panel has a rather pleasing appearance which would not detract from the appearance of a building on which it was installed since in the storage position all that is visible is the cover plate and the unobtrusive trip levers which can be designed to be nearly inconspicuous. Moreover, design possibilities are enhanced by variety or suitable cover panel materials, such as structural aluminum, fiberglass or plastic panels. For instance, in a building utilizing tinted or mirrored glass in the windows, the covering over the ladder unit can be tinted or mirrored plastic either transparent or opaque, as desired. In such a case, the windows containing the ladder unit would be virtually indistinguishable from the other windows from the outside of the building. Aside from the esthetic advantages, the use of such a covering would also serve to obstruct the escapee's outward view and thus provide a safety feature by reducing the escapee's consciousness of height.

DETAILED DESCRIPTION OF THE DRAWINGS

Figure 1:
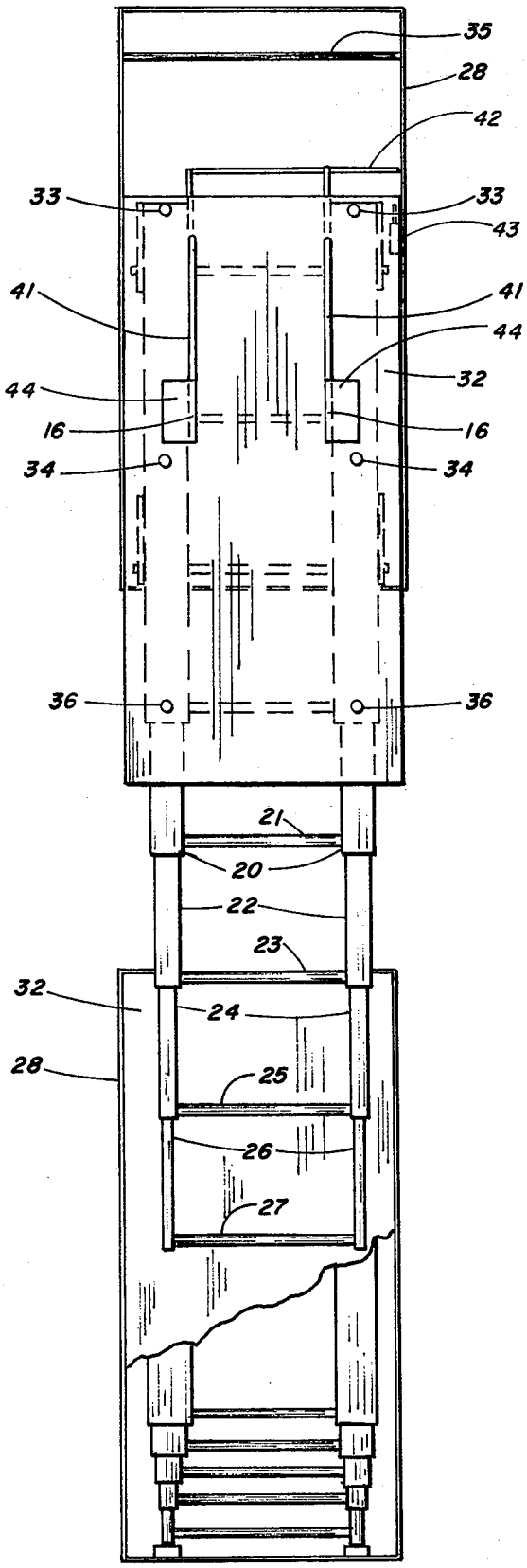
FIG. 1 is a front elevation of the ladder assembly of this invention installed in two floors of a building. In the upper floor the ladder is in the extended position. In the lower floor the ladder is in the storage position with part of the cover panel cut away.
Figure 2:
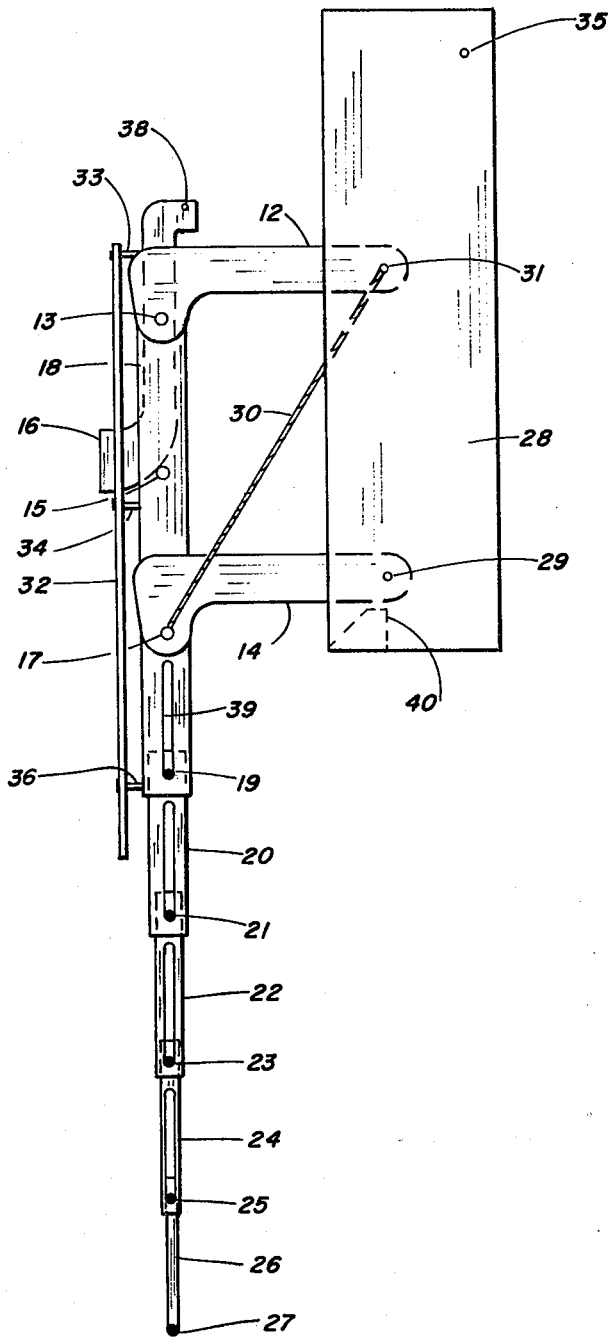
FIG. 2 is a side elevation of the ladder assembly in the extended position.
Figure 3:
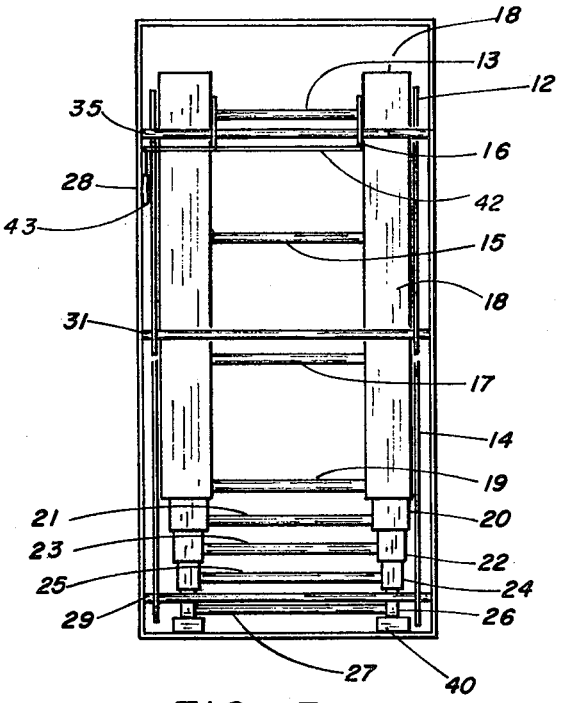
FIG. 3 is a view of the ladder assembly from the inside of the frame.

Referring to the drawings, a preferred embodiment of the ladder assembly comprising a frame, ladder and cover panel is described. The ladder comprises several telescoping sections made of square tubular aluminum, for example including an upper stile member 18, intermediate stile members 20, 22 and 24, and lower stile member 26. Lower stile members can be made of bar stock. The telescoping ladder is mounted in frame 28 by means of a pair of supporting arms comprising upper supporting arms 12 and lower supporting arms 14. Upper supporitng arms 12 are pivotally mounted to the frame 28 by means of hinge pin 31 and pivotally mounted to the upper stile members 18 by hinge pin/-rung 13. Similarly, lower supporting arms 14 are pivotally mounted to frame 28 by hinge pin 29 and to the upper stile members 18 by hinge pin/rung 17. A pair of tension members 30 made of cable, for example, connecting between hinge pin/rung 17 and hinge pin 31 restrict the degree of movement of the ladder on the supporting arm and define the position of the telescoping ladder relative to the frame when the ladder is in the extended position.

Figure 4:
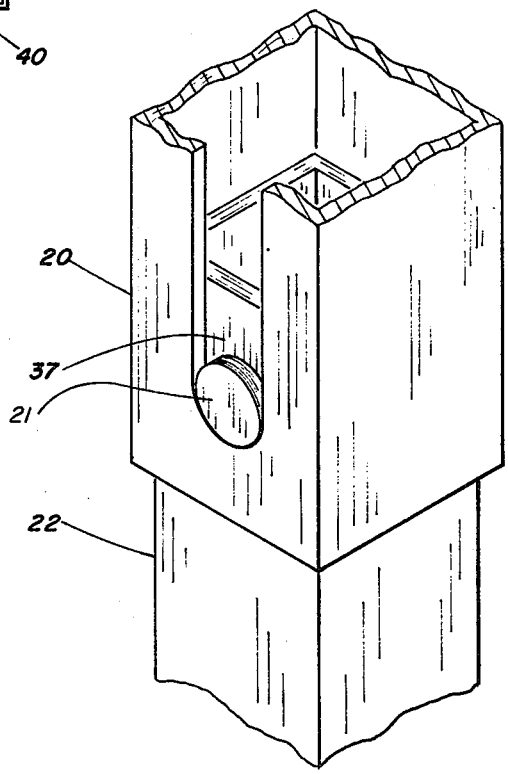
FIG. 4 is a detailed view of the stop assembly in the stile members.

The ladder is provided with rungs spaced at suitable intervals. The upper stile members 18 are connected by rung 15 as well as previously described members 13 and 17 which function as both rungs and hinge pins for the supporting arms. Intermediate stile members 20 are connected by rung members 19 and 21. Rung member 19 extends through the stile members 20 and is accommodated in the slots 39 provided in upper stile members 18. Thus, rung 19 acts as a stop limiting the telescoping of stile members 20 from stile members 18. Stile members 22, 24 and 26 are provided with rung members 23, 25 and 27 respectively. Rung members 21, 23 and 25 extend through the stile members in which they are mounted as shown in detail in FIG. 4 where the rung member 21 mounted on stile member 22 extends through the member 22 and is accomodated in slot 37 provided in stile member 20.

In the storage position the ladder in its collapsed state is entirely accommodated in the frame member 28 being held by trip lever 16 which pivots on hinge pin/-rung 13 and hooks over trip bar 35. Trip lever 16 can be disengaged from its storage position by a downward force on the strike plates 44, which are attached to the trip lever outside the frame (meaning the side provided with cover panel 32), or by an upward force on the trip lever inside the frame such as by forcing release bar 38 upward manually.

In the storage position rung member 27 rests on slide 40. When trip lever 16 is disengaged from trip bar 35 the ladder falls, by gravity or with only slight outward force, downwardly and outwardly with rung 27 sliding on slide 40 until the rung is clear of the frame when telescoping of the ladder to the fully extended position occurs by gravity.

The ladder assembly is provided with a cover panel 32 made of any protective or decorative material such as plastic or aluminum. The cover panel 32 is attached to upper stile member 18 using spacers 33, 34 and 36 so that sufficient toe room is provided between the ladder and the panel for a person using the ladder. Cover panel 32 is provided with slots 41 for trip lever 16.

The ladder assembly of this invention is best utilized in a system of several assemblies each installed in windows of a building one above each other. In this arrangement the length of the ladders in the extended condition and the outward extension trip levers 16 are such that the release of a ladder causes lower rung 27 of that ladder to strike trip lever 16 on the ladder below causing its release. Similarly, all ladders below will be released providing safe access to ground level.

Figure 5:
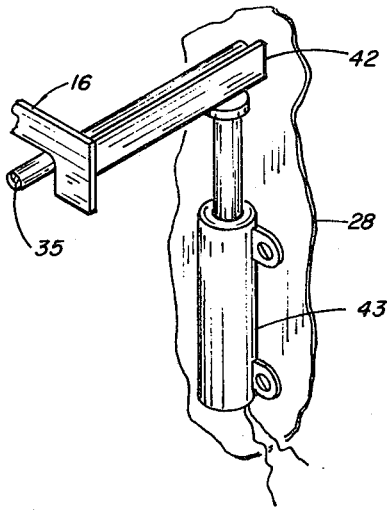
FIG. 5 is a detailed view of an electromechanical actuation device for releasing the ladder of this invention.

As indicated above the ladder can be released manually from the inside or from the outside by contact with a ladder mounted above. It may be desirable to provide in addition an electromechanical release means as shown in FIG. 5. A solenoid or similar device 43 is mounted on frame 28. When energized the solenoid 43 exerts an upward force on bar 42 attached to trip lever 16 whereby it is disengaged from trip bar 35.

The ladder can also be constructed in the manner described in my copending application Ser. No. 427,012, filed Dec. 13, 1973 which is incorporated herein by reference in its entirety.

Having set forth my invention and what is considered to be the best embodiment thereof, it will be understood that changes may be made from the specific embodiments set forth without departing from the spirit of the invention exceeding the scope thereof as defined in the following claims.

I claim:

1. A ladder assembly in which the ladder is collapsible for storage and extensible for use comprising a box-like frame member and a collapsible ladder; said ladder capable of being enclosed within said box-like frame member in the storage position; said ladder comprising a plurality of telescoping stile pairs including an upper stile pair and a lower stile pair and a plurality of rung members, said ladder having an extended length of not less than 1.3 times the height of said frame; said ladder being attached to said frame member by at least two pairs of pivoted arms and said ladder capable of being accommodated in said frame member in the storage position and capable of movement to an extended position in which said upper pair of stile members moves outwardly and downwardly on said pivoted arms to a predetermined vertical position sufficient to allow passage of a person between said frame and said ladder; said ladder being secured in the extended position by tension means connecting between said ladder and frame member; and said ladder assembly including a cover panel attached to said upper stile pair which cover panel substantially closes the outside opening in said box-like frame member.

2. The ladder assembly of claim 1 in which each of said telescoping stile pairs is connected by at least one rung member.

3. The ladder assembly of claim 1 in which the plurality of telescoping stile pairs includes an upper stile pair, a lower stile pair and at least one intermediate stile pair.

4. The ladder assembly of claim 3 in which the upper stile pair is connected by a plurality of rung members and the lower and intermediate stile pairs are connected by at least one rung disposed adjacent the bottom of said intermediate and lower stile pairs.

5. The ladder assembly of claim 1 having means for releasing said ladder from the storage position to the use position which means can be actuated from either the inside or the outside of said assembly wherein the outside constitutes the side of the use position.

6. The ladder assembly of claim 5 in which said means for releasing the ladder from the outside comprised a trip lever means attached to said upper stile pair which cooperates with a securing means attached to said frame member to hold the ladder in the storage position, said trip lever extending outside said frame member and being capable of disengagement from said securing means by a downward force applied to said trip lever means at a point outside the frame.

7. The ladder assembly of claim 5 having electrically responsive release means.

8. A ladder system for a multistory structure comprising a plurality of ladder assemblies of claim 6 in which said ladder assemblies are disposed one above another so that the release of one ladder triggers the release of the next lower ladder by the downward force of the upper ladder on the trip lever of the next lower ladder.

* * * * *